US008431518B2

(12) United States Patent
Brooker et al.

(10) Patent No.: US 8,431,518 B2
(45) Date of Patent: Apr. 30, 2013

(54) DETERGENT COMPOSITION

(75) Inventors: Anju Deepali Massey Brooker, Newcastle upon Tyne (GB); Yvonne Bridget McMeekin, Northumderland (GB); Phan Shean Lim, Newcastle upon Tyne (GB); Fernando Solache Leon, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 133 days.

(21) Appl. No.: 12/965,095

(22) Filed: Dec. 10, 2010

(65) Prior Publication Data

US 2011/0143987 A1 Jun. 16, 2011

(30) Foreign Application Priority Data

Dec. 10, 2009 (EP) ..... 09178697

(51) Int. Cl.

| | |
|---|---|
| ***C11D 17/00*** | (2006.01) |
| ***C11D 17/04*** | (2006.01) |
| ***C11D 1/72*** | (2006.01) |
| ***C11D 3/26*** | (2006.01) |
| ***C11D 3/37*** | (2006.01) |
| ***C11D 3/386*** | (2006.01) |
| ***B08B 9/20*** | (2006.01) |

(52) U.S. Cl.

USPC ..... 510/220; 510/224; 510/226; 510/229; 510/230; 510/392; 510/421; 510/477; 510/480; 510/505; 510/506; 134/25.2

(58) Field of Classification Search ..... 510/220, 510/224, 226, 229, 230, 392, 421, 439, 441, 510/444, 477, 505, 506; 134/25.2

See application file for complete search history.

(56) References Cited

U.S. PATENT DOCUMENTS

| | | | | |
|---|---|---|---|---|
| 6,093,562 | A | 7/2000 | Bisgard-Frantzen et al. | |
| 6,187,739 | B1 | 2/2001 | Merz et al. | |
| 6,331,512 | B1 | 12/2001 | Foote et al. | |
| 6,395,694 | B1 * | 5/2002 | Littau | 510/276 |
| 6,881,713 | B2 * | 4/2005 | Sommerville-Roberts et al. | 510/296 |
| 6,908,896 | B2 * | 6/2005 | Bauer et al. | 510/511 |
| 7,595,291 | B2 | 9/2009 | Bittner et al. | |
| 7,879,154 | B2 | 2/2011 | Warkotsch et al. | |
| 2003/0186828 | A1 | 10/2003 | Holderbaum et al. | |
| 2006/0178286 | A1 * | 8/2006 | Hsu et al. | 510/421 |
| 2008/0167215 | A1 * | 7/2008 | Bittner et al. | 510/505 |
| 2008/0188391 | A1 | 8/2008 | Seebeck et al. | |
| 2010/0041574 | A1 | 2/2010 | Warkotsch et al. | |
| 2010/0154832 | A1 | 6/2010 | Zipfel et al. | |
| 2010/0160204 | A1 | 6/2010 | Zipfel et al. | |
| 2010/0294309 | A1 | 11/2010 | Tropsch | |
| 2010/0305018 | A1 | 12/2010 | Bittner et al. | |

FOREIGN PATENT DOCUMENTS

| | | | |
|---|---|---|---|
| EP | 0 629 690 | A1 | 12/1994 |
| EP | 1 600 497 | A1 | 11/2005 |
| EP | 1 904 613 | A1 | 4/2008 |
| WO | WO 00/37627 | A1 | 6/2000 |
| WO | WO 02/068577 | A1 | 9/2002 |
| WO | WO 2007/068920 | A1 | 6/2007 |
| WO | WO 2008/035071 | A1 | 3/2008 |
| WO | WO 2008/110816 | A1 | 9/2008 |
| WO | WO 2010/031605 | A1 | 3/2010 |

OTHER PUBLICATIONS

U.S. Appl. No. 12/965,074, filed Dec. 10, 2010, Anju Deepali Massey Brooker.

U.S. Appl. No. 12/965,119, filed Dec. 10, 2010, Anju Deepali Massey Brooker.

U.S. Appl. No. 12/965,132, filed Dec. 10, 2010, Paul Lapham.

U.S. Appl. No. 12/965,150, filed Dec. 10, 2010, Paul Lapham.

Barker G E and Kern C R: "A comparison two methods for testing detergents"; The journal of the American Oil Chemists' Society; vol. 27, No. 4, 1950, pp. 113-116, XP002565175.

International Search Report 5 Pages, for PCT/US2010059470 mailed on Feb. 21, 2011.

* cited by examiner

*Primary Examiner* — Lorna M Douyon

(74) *Attorney, Agent, or Firm* — Tiffany M. Zerby; Steven W. Miller

(57) ABSTRACT

Automatic dishwashing detergent composition for use in the main wash of a dishwasher to provide drying wherein the detergent comprises an esterified alkyl alkoxylated surfactant of general formula (I)

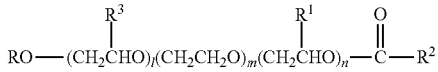

where

R is a branched or unbranched alkyl radical having 8 to 16 carbon atoms;

$R^3$, $R^1$ independently of one another, are hydrogen or a branched or unbranched alkyl radical having 1 to 5 carbon atoms;

$R^2$ is an unbranched alkyl radical having 5 to 17 carbon atoms;

l, n independently of one another, are a number from 1 to 5 and m is a number from 13 to 35; and a dispersant selected from the group of organic polymers, organic builders and mixtures thereof.

9 Claims, No Drawings

DETERGENT COMPOSITION

TECHNICAL FIELD

The present invention is in the field of detergents. In particular, it relates to an automatic dishwashing detergent composition capable of providing drying through the wash (i.e., a drying aid is provided during the main wash and the washed load presents improved drying at the end of the automatic dishwashing operation) and at the same time good shine.

BACKGROUND

One of the unmet dishwasher user needs is the drying of cleaned items after the dishwashing process. At the end of an automatic dishwashing operation, items, in particular plastic items, are usually wet. They need to be dried by the user before they can be put away. This requires an extra step. Dishwasher's users always like to minimise the amount of work needed from when items are soiled until when the items are put away in the cupboards. Different proposals have been put forward to improve drying in the dishwashing process. WO 2008/110816 proposes the use of certain anionic polyesters to provide drying. WO 2009/033972 proposes a composition comprising a specific non-ionic surfactant in combination with a sulfonated polymer. WO 2009/033830 proposes a dishwashing process involving delivery of surfactant and anionic polymers at two different moments in time. WO 2008/119834 proposes a composition comprising specific polycarbonate-, polyurethane- and/or polyurea-polyorganosiloxane compounds.

Rinse aid could help with the drying of items, however this implies the purchase and use of an extra product and as we pointed out before dishwasher's users likes to simplify the dishwashing task as much as possible.

The objective of this invention is to provide an automatic dishwashing product that provides good drying through the wash (i.e. it does not need the addition of a separate product in the rise cycle) and at the same time provides good cleaning and finishing of the washed items. Another objective is to enable more environmentally friendly dishwashing processes, ie. processes that involves reduced amount of time and/or reduced amount of energy, as for example reduced drying time.

SUMMARY OF THE INVENTION

According to a first aspect of the invention, there is provided an automatic dishwashing detergent for use in the main wash cycle (herein also referred to as "main wash") of a dishwasher. An automatic dishwashing operation typically comprises three or more cycles: a pre-wash cycle, a main-wash cycle and one or more rinse cycles, these cycles are usually followed for a drying cycle. The detergent composition of the present invention is to be delivered into the main wash.

The detergent composition of the invention provides good drying, in particular on plastic items. Plastic items are difficult to dry due to their hydrophobic nature. The detergent composition of the invention comprises an esterified alkyl alkoxylated surfactant of general formula (I)

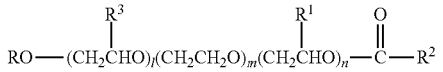

where

R is a branched or unbranched alkyl radical having 8 to 16 carbon atoms, preferably from 10 to 16 and more preferably from 12 to 15;

$R^3$, $R^1$ independently of one another, are hydrogen or a branched or unbranched alkyl radical having 1 to 5 carbon atoms; preferably $R^a$ and $R^l$ are hydrogen $R^2$ is an unbranched alkyl radical having 5 to 17 carbon atoms; preferably from 6 to 14 carbon atoms l, n independently of one another, are a number from 1 to 5 and m is a number from 13 to 35; and a dispersant selected from the group of organic polymers, organic builders and mixtures thereof.

By "dispersant" herein is meant any compound capable of dispersing (i.e. maintain suspended in the wash liquor) either metallic ions, such as calcium, iron, and any other metallic ions found in a dishwashing liquor and/or soils found in a dishwashing liquor. The dispersant helps to avoid the deposition of scale and re-deposition of soils on the washed items thereby contributing to provide good drying and at the same time lack of filming and spotting on the washed objects, resulting on improved shine.

Preferred dispersants for use herein are selected from the group of organic polymers, organic builders and mixtures thereof. In a preferred embodiment the organic polymer is a carboxylated polymer, in particular a polyacrylic acid polymer.

Preferred organic builders for use herein include MGDA, GLDA, IDS, carboxymethyl inulin, citric acid their salts and mixtures thereof. These organic builders have good dispersant properties and at the same time present a good environmental profile. The dispersant properties contribute to good cleaning, finishing and improved drying.

In an especially preferred embodiment R has from 12 to 15, preferably 13 carbon atoms, $R^3$ and $R^1$ are hydrogen, 1 is 5, n is 1, m is from 15 to 25, preferably 22 and $R^2$ has from 6 to 14 carbon atoms.

In especially preferred embodiments the detergent of the invention comprises an alcohol alkoxylated surfactant. It has been surprisingly found that automatic dishwashing detergents comprising a mixture of these two surfactants (esterified alkyl alkoxylated and alcohol alkoxylated) provide better drying than compositions comprising any of the two surfactants on their own. Preferably the alcohol alkoxylated surfactant surfais ethoxylated and it has an aliphatic alcohol chain containing from about 10 to 14, more preferably about 13 carbon atoms and from 5 to 8, more preferably 7 molecules of ethylene oxide.

The detergent composition of the invention provides specially good drying when the esterified alkyl akoxylated surfactant is as follows: R has from 12 to 15, preferably 13 carbon atoms, $R^3$ is hydrogen, $R^1$ is hydrogen, 1 is 5, n is 1, m is from 15 to 25, preferably 22 and $R^2$ has from 6 to 14 carbon atoms and the alcohol ethoxyolated surfactant has an aliphatic alcohol chain containing from about 10 to 14, more preferably about 13 carbon atoms and from 5 to 8, more preferably 7 molecules of ethylene oxide.

Outstanding drying can be obtained when the esterified alkyl alkoxylated surfactant and the alcohol ethoxylated surfactant are in a weight ratio of from about 1:1 to about 10:1, preferably from about 2:1 to about 8:1 and more preferably from about 4:1 to about 6:1.

In preferred embodiments the total amount of surfactant is from about 2 to about 20, preferably from about 3 to about 15 and more preferably from about 5 to about 12% by weight of the composition.

In preferred embodiments the detergent of the invention comprises an enzyme selected from an amylase, a protease and a mixture thereof. A preferred proteases for use herein include a protease demonstrating at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627: 68, 87, 99, 101, 103, 104, 118, 128, 129, 130, 167, 170, 194, 205 & 222 and optionally one or more insertions in the region comprising amino acids 95-103. Preferably, the mutations are selected from one or more, preferably two or more and more preferably three or more of the following: V68A, N87S, S99D, S99SD, S99A, S101G, S103A, V104N/I, Y167A, R170S, A194P, V205I and/or M222S.

In preferred embodiments the detergent of the invention comprises an amylase exhibiting at least 95%, preferably at least 98% identity with the wild-type enzyme from *Bacillus* sp. 707 (SEQ ID NO:7 in U.S. Pat. No. 6,093,562), especially an amylase comprising one or more of the following mutations M202, M208, S255, R172, and/or M261. Preferably said amylase comprises one or more of M202L, M202V, M202S, M202T, M202I, M202Q, M202W, S255N and/or R172Q. Particularly preferred are those amylases comprising the M202L or M202T mutations. Especially preferred for use herein is a mixture of the amylase and protease described herein before. Compositions comprising this protease and/or amylase provide improved cleaning thereby positively impacting on the final drying of the washed items.

The detergent composition of the invention can be in any form, including solid, liquid, gel. In a preferred embodiment the detergent composition is in solid form, more preferably particulate form. Particulate form can be loose powder or densified powder (i.e., tablet or water-soluble pouch). When the detergent composition is in solid form the esterified alkyl alkoxylated surfactant is preferably added as liquid, for example sprayed onto the particles. This helps to keep the surfactant pre-disperse, preferably the surfactant sprayed on the particulate composition is dusted with inorganic material, such as sodium carbonate to confer good flowing properties to the particles. It has herein being observed that improved drying benefits are obtained when the esterified alkyl alkoxylated surfactant has been sprayed onto a particulate composition. Without wishing to be bound by theory, it is believed that the pre-dispersed esterified alkyl alkoxylated surfactant dissolves/disperses quickly and provides a greater drying effect.

In a preferred embodiment, the composition is in unit dose form (i.e. amount to be sufficient for a single wash). Suitable unit dose forms include tablet, capsules, sachets, pouches, etc. Especially preferred for use herein are pouches, single and multi-compartment pouches. The pouches preferably have a weight from about 15 to about 25 grams, more preferably from about 17 to about 22 grams. A specially preferred embodiment provides a unit dose product in the form of a multi-compartment pouch. Preferably the pouch comprises a compartment containing a liquid and another compartment containing a solid composition. In some embodiments the esterified alkyl alkoxylated surfactant of the invention is placed in both compartments, i.e., part in the liquid and part in the solid containing compartment.

According to another aspect of the invention, there is provided a method of dishwashing in a dishwasher comprising the step of delivering a detergent comprising an esterified alkyl alkoxylated surfactant of general formula (I)

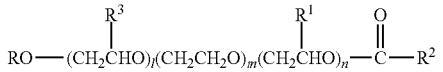

where

R is a branched or unbranched alkyl radical having 8 to 16 carbon atoms, preferably from 10 to 16 and more preferably from 12 to 15;

$R^3$, $R^1$ independently of one another, are hydrogen or a branched or unbranched alkyl radical having 1 to 5 carbon atoms; preferably $R^a$ and $R^l$ are hydrogen $R^2$ is an unbranched alkyl radical having 5 to 17 carbon atoms; preferably from 6 to 14 carbon atoms l, n independently of one another, are a number from 1 to 5 and m is a number from 13 to 35 or the detergent composition of the invention into the main wash of the dishwasher. The method of the invention obviates the use of additional rinse aid to obtain good drying, thereby simplifying the dishwashing task. Furthermore, the method of the invention allows for time or heat reduction of the drying cycle.

According to the last aspect of the invention, there is provided the use of a detergent comprising an esterified alkyl alkoxylated surfactant of general formula (I)

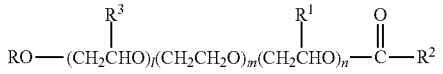

where

R is a branched or unbranched alkyl radical having 8 to 16 carbon atoms, preferably from 10 to 16 and more preferably from 12 to 15;

$R^3$, $R^1$ independently of one another, are hydrogen or a branched or unbranched alkyl radical having 1 to 5 carbon atoms; preferably $R^a$ and $R^l$ are hydrogen $R^2$ is an unbranched alkyl radical having 5 to 17 carbon atoms; preferably from 6 to 14 carbon atoms l, n independently of one another, are a number from 1 to 5 and m is a number from 13 to 35 or the detergent composition of the invention to provide drying through the wash in an automatic dishwashing operation.

DETAILED DESCRIPTION OF THE INVENTION

The present invention envisages a detergent composition comprising an esterified alkyl alkoxylated surfactant and a dispersant. The composition provides excellent drying, even on plastic items, as well as good cleaning and finishing (lack of filming and spotting and good shine). The present invention also envisages a method of dishwashing using a composition comprising an esterified alkyl alkoxylated surfactant or the composition of the invention during the main wash of a dishwashing operation. Finally, there is also provided the use of a composition comprising an esterified alkyl alkoxylated surfactant or the composition of the invention to provide improved drying during the dishwashing operation.

Surfactants

Esterified Alkyl Alkoxylated Surfactant

The detergent composition of the invention comprises an esterified alkyl alkoxylated surfactant of general formula (I)

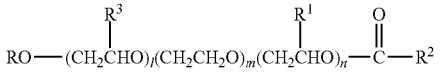

where

R is a branched or unbranched alkyl radical having 8 to 16 carbon atoms;

$R^3$, $R^1$ independently of one another, are hydrogen or a branched or unbranched alkyl radical having 1 to 5 carbon atoms;

$R^2$ is an unbranched alkyl radical having 5 to 17 carbon atoms;

l, n independently of one another, are a number from 1 to 5 and m is a number from 13 to 35;

Preferably, the radical R is a branched alkyl radical having 9 to 16, more preferably having 10 to 13, carbon atoms. The degree of branching is preferably 1-3. For the purposes of the present invention, the term "degree of branching" is understood as meaning the number of methyl groups reduced by 1.

Further preferably, $R^3$, $R^1$ independently of one another, are hydrogen, methyl and ethyl. If $R^3$, $R^1$ occur more frequently, then each can be chosen independently of a further $R^3$ or $R^1$. Thus $R^a$, $R^l$ can occur blockwise or in random distribution.

$R^2$ is preferably a branched or unbranched alkyl radical having 5 to 13 carbon atoms.

Preferably n=1, l=5 and m is preferably a number from 13 to 34, more preferably 13 to 33, even more preferably 13 to 30, most preferably 17 to 27.

Further preferably, the average molecular weight is in a range from 950 to 2300 g/mol, more preferably from 1200 to 1900 g/mol.

The esterified alkyl alkoxylated surfactant of the invention is a low foaming surfactant. By "low foaming non-ionic surfactant" is herein understood a surfactant in a dishwashing liquor at a concentration of 250 ppm in an automatic dishwashing operation that creates suds below 5 cm, more preferably below 3 cm, more preferably below 2 cm, more preferably below 1 cm and specially below 0.5 cm. Suds height is measured in the absence of soils by attaching a ruler to the wall of a dishwasher and measuring the height from the wash liquor to the top of the suds at the end of the main wash.

The esterified surfactant is stable in an alkaline environment. Preferably the esterified surfactant has a melting point above 25° C., more preferably above 35° C.

The esterified surfactant of the invention can be synthesized as described in US2008/0167215, paragraphs [0036] to [0042], herein included by reference.

Alcohol Alkoxylated Surfactant

An alcohol alkoxylated surfactant is a compound obtained by the condensation of alkylene oxide groups with an organic hydrophobic material which may be aliphatic or alkyl aromatic in nature, preferably is a compound selected from the group consisting of a C2-C18 alcohol alkoxylate having EO, PO and/or BO moieties. The moieties can be in block configuration or randomly distributed.

Preferably the alcohol alkoxylated surfactant is an alcohol ethoxylated surfactant, substantially free of other alkoxylated groups (i.e. less than 10%, more preferably less than 5% and especially less than 1% of alkoxylated groups other than ethoxy groups). Suitable herein are primary alcohols having preferably from 8 to 18 carbon atoms and on average from 1 to 12 mol of ethylene oxide (EO) per mole of alcohol in which the alcohol radical may be linear or 2-methyl-branched, or may contain a mixture of linear and methyl-branched radicals, as are typically present in oxo alcohol radicals. Preferred alcohol ethoxylated surfactants have linear radicals of alcohols of natural origin having from 12 to 18 carbon atoms, for example, of coconut, palm, tallow fat or oleyl alcohol, and on average from 2 to 8 EO per mole of alcohol. Preferred ethoxylated alcohols include, for example, C12-14-alcohols having 3 EO or 4 EO, C9-11-alcohol having 7 EO, C13-15-alcohols having 3 EO, 5 EO, 7 EO or 8 EO, C12-18-alcohols having 3 EO, 5 EO or 7 EO and mixtures thereof, such as mixtures of C12-14-alcohol having 3 EO and C12-18-alcohol having 5 EO. The degrees of ethoxylation specified are statistical average values which may be an integer or a fraction for a specific product. Preferred alcohol ethoxylates have a narrowed homolog distribution (narrow range ethoxylates, NRE). In addition to these surfactants, it is also possible to use fatty alcohols having more than 12 EO. Examples thereof are tallow fatty alcohol having 14 EO, 25 EO, 30 EO or 40 EO.

Particularly preferred are the condensation products of alcohols having an alkyl group containing from about 8 to about 14 carbon atoms with an average of from about 6 to about 8 moles of ethylene oxide per mole of alcohol. Preferably at least 25%, more preferably at least 75% of the surfactant is a straight-chain ethoxylated primary alcohol. It is also preferred that the HLB (hydrophilic-lipophilic balance) of the alcohol alkoxylated be less than about 18, preferably less than about 15 and even more less than 14. Commercially available products for use herein include Lutensol® TO series, C13 oxo alcohol ethoxylated, supplied by BASF, especially suitable for use herein being Lutensol® TO7.

Other suitable alcohol ethoxylated surfactants for use herein are C2-C18 alcohol alkoxylated surfactants having EO, PO and/or BO moieties having either random or block distribution. Especially preferred for use herein is a surfactant system comprising an ethoxylated alcohol, preferably a C10-C16 alcohol having from 4 to 10 ethoxy groups. Preferably, the alkoxylated alcohol is in a level of from about 0.1% to about 20%, preferably from about 1% to about 10% and more preferably from about 4% to about 8% by weight of the detergent composition.

Other suitable alkoxylated alcohols for use herein include a C2-C18 alcohol alkoxylate having EO, PO and/or BO moieties, specially a C2-C18 alcohol comprising EO and BO moieties in a random configuration. Particularly preferred are the following fatty alcohol alkoxylates such as Adekanol B2020 (Adeka), Dehypon LS36 (Cognis), Plurafac LF 221 (C13-15, EO/BO (95%)), Plurafac LF 300, Plurafac LF 303 (EO/PO), Plurafac LF 1300, Plurafac LF224, Degressal SD 20 (polypropoxylate) (all from BASF), Surfonic LF 17 (C12-18 ethoxylated propoxylated alcohol, Huntsman), Triton EF 24 (Dow), Neodol ethoxylates from Shell.

Also suitable for use herein are polyoxyalkene condensates of aliphatic carboxylic acids, whether linear- or branched-chain and unsaturated or saturated, especially ethoxylated and/or propoxylated aliphatic acids containing from about 8 to about 18 carbon atoms in the aliphatic chain and incorporating from about 2 to about 50 ethylene oxide and/or propylene oxide units. Suitable carboxylic acids include coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid.

Also suitable for use herein are polyoxyalkene condensates of aliphatic alcohols, whether linear- or branched-chain and unsaturated or saturated, especially ethoxylated and/or propoxylated aliphatic alcohols containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol.

Other example types of nonionic surfactants are linear fatty alcohol alkoxylates with a capped terminal group, as described in U.S. Pat. No. 4,340,766 to BASF.

Other example type includes olyoxyethylene-polyoxypropylene block copolymers haying formula:

$$HO(CH2CH2O)a(CH(CH3)CH2O)b(CH2CH2O)cH;$$

or $$HO(CH(CH3)CH2O)d(CH2CH2O)e(CH(CH3)CH2O)H$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material can for instance have a molecular weight of between about 1,000 and about 15,000, more specifically from about 1,500 to about 6,000. These materials are well-known in the art. They are available under the trademark "Pluronic" and "Pluronic R", from BASF Corporation.

Cleaning Actives

Any cleaning ingredient can be used as part of the product of the invention. The levels given are weight percent and refer to the total composition (excluding the enveloping water-soluble material, in the case of unit dose forms having a wrapper or enveloping material). The composition can contain a phosphate builder or be free of phosphate builder and comprise one or more detergent active components which may be selected from bleach, bleach activator, bleach catalyst, alkalinity sources, organic polymers, anti-corrosion agents (e.g. sodium silicate) and care agents. Highly preferred cleaning components for use herein include a builder compound, an alkalinity source, an organic polymer and an enzyme.

Builder

Builders for use herein include inorganic builders (preferably phosphate) and organic builders. If present, builders are used in a level of from 5 to 60%, more preferably from 10 to 50% by weight of the composition. In some embodiments the product comprises a mixture of inorganic and organic builders.

Inorganic Builders

Preferred inorganic builders include carbonates and phosphate builders, in particular mono-phosphates, di-phosphates, tri-polyphosphates or oligomeric-poylphosphates. The alkali metal salts of these compounds are preferred, in particular the sodium salts. An especially preferred builder is sodium tripolyphosphate (STPP).

Organic Builders

Preferred organic builders include amino acid based compounds, in particular MGDA (methyl-glycine-diacetic acid), GLDA (glutamic-N,N-diacetic acid), iminodisuccinic acid (IDS), carboxymethyl inulin and salts and derivatives thereof. GLDA (salts and derivatives thereof) is especially preferred according to the invention, with the tetrasodium salt thereof being especially preferred. Preferably MGDA or GLDA are present in the composition of the invention in a level of from 0.5% to 50%, more preferably from about 1% to about 20% and especially from about 2 to about 10% by weight of the composition.

Other suitable organic builders include amino acid based compound or a succinate based compound. The term "succinate based compound" and "succinic acid based compound" are used interchangeably herein. Other suitable builders are described in U.S. Pat. No. 6,426,229. Particular suitable builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl) aspartic acid (SEAS), N-(2-sulfomethyl) glutamic acid (SMGL), N-(2-sulfoethyl) glutamic acid (SEGL), IDS (iminodiacetic acid) and salts and derivatives thereof such as N-methyliminodiacetic acid (MIDA), alpha-alanine-N,N-diacetic acid (alpha-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof.

Carboxymethyl inulin is also a non-phosphate builder suitable for use herein. Carboxymethyl inulin is a carboxyl-containing fructan where the carboxyl is carboxymethyl and the fructan has β-2,1 bond. The carboxymethyl inulin is typically supplied as an alkali metal salt such as sodium carboxymethyl inulin. A suitable source of the carboxymethyl inulin is Dequest SPE 15625 from Thermphos International. The carboxymethyl inulin may have a degree of substitution ranging from about 1.5 to about 3, and may in some embodiments be about 2.5.

Preferably the organic builder is present in the composition in an amount of at least 1%, more preferably at least 5%, even more preferably at least 10%, and most especially at least 20% by weight of the total composition. Preferably these builders are present in an amount of up to 50%, more preferably up to 45%, even more preferably up to 40%, and especially up to 35% by weight of the total composition. In preferred embodiments the composition contains 20% by weight of the total composition or less of phosphate builders, more preferably 10% by weight of the total composition or less, most preferably they are substantially free of phosphate builders.

Other organic builders include polycarboxylic acids. Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethyl enedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Other suitable builders are disclosed in WO 95/01416, to the contents of which express reference is hereby made.

Organic Polymer

The polymer, if present, is used in any suitable amount from about 0.1% to about 50%, preferably from 0.5% to about 20%, more preferably from 1% to 10% by weight of the composition.

Preferred organic polymers herein include acrylic acid containing polymers such as Sokalan PA30, PA20, PA15, PA10 and Sokalan CP10 (BASF GmbH), Acusol 45N, 480N, 460N (Rohm and Haas), acrylic acid/maleic acid copolymers such as Sokalan CP5 and acrylic/methacrylic copolymers. Preferred soil release polymers herein include alkyl and hydroxyalkyl celluloses (U.S. Pat. No. 4,000,093), polyoxyethylenes, polyoxypropylenes and copolymers thereof, and nonionic and anionic polymers based on terephthalate esters of ethylene glycol, propylene glycol and mixtures thereof.

Sulfonated/carboxylated polymers are particularly suitable for the composition of the invention.

Suitable sulfonated/carboxylated polymers described herein may have a weight average molecular weight of less than or equal to about 100,000 Da, or less than or equal to about 75,000 Da, or less than or equal to about 50,000 Da, or from about 3,000 Da to about 50,000, preferably from about 5,000 Da to about 45,000 Da.

As noted herein, the sulfonated/carboxylated polymers may comprise (a) at least one structural unit derived from at least one carboxylic acid monomer having the general formula (I):

(I)

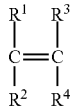

wherein R1 to R4 are independently hydrogen, methyl, carboxylic acid group or CH2COOH and wherein the carboxylic acid groups can be neutralized; (b) optionally, one or more structural units derived from at least one nonionic monomer having the general formula (II):

(II)

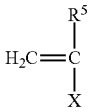

wherein R5 is hydrogen, C1 to C6 alkyl, or C1 to C6 hydroxyalkyl, and X is either aromatic (with R5 being hydrogen or methyl when X is aromatic) or X is of the general formula (III):

(III)

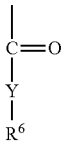

wherein R6 is (independently of R5) hydrogen, C1 to C6 alkyl, or C1 to C6 hydroxyalkyl, and Y is O or N; and at least one structural unit derived from at least one sulfonic acid monomer having the general formula (IV):

(IV)

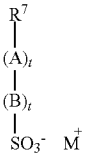

wherein R7 is a group comprising at least one sp2 bond, A is O, N, P, S or an amido or ester linkage, B is a mono- or polycyclic aromatic group or an aliphatic group, each t is independently 0 or 1, and M+ is a cation. In one aspect, R7 is a C2 to C6 alkene. In another aspect, R7 is ethene, butene or propene.

Preferred carboxylic acid monomers include one or more of the following: acrylic acid, maleic acid, itaconic acid, methacrylic acid, or ethoxylate esters of acrylic acids, acrylic and methacrylic acids being more preferred. Preferred sulfonated monomers include one or more of the following: sodium (meth) allyl sulfonate, vinyl sulfonate, sodium phenyl (meth) allyl ether sulfonate, or 2-acrylamido-methyl propane sulfonic acid. Preferred non-ionic monomers include one or more of the following: methyl (meth)acrylate, ethyl (meth) acrylate, t-butyl (meth) acrylate, methyl (meth) acrylamide, ethyl (meth) acrylamide, t-butyl (meth) acrylamide, styrene, or α-methyl styrene.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

The carboxylic acid is preferably (meth)acrylic acid. The sulfonic acid monomer is preferably one of the following: 2-acrylamido methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, allyloxybenzenesulfonic acid, methallyloxybenzensulfonic acid, 2-hydroxy-3-(2-propenyloxy)propanesulfonic acid, 2-methyl-2-propene-1-sulfonic acid, styrene sulfonic acid, vinylsulfonic acid, 3-sulfopropyl acrylate, 3-sulfopropyl methacrylate, sulfomethylacrylamid, sulfomethylmethacrylamide, and water soluble salts thereof. The unsaturated sulfonic acid monomer is most preferably 2-acrylamido-2-propanesulfonic acid (AMPS).

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

Other suitable organic polymer for use herein includes a polymer comprising an acrylic acid backbone and alkoxylated side chains, said polymer having a molecular weight of from about 2,000 to about 20,000, and said polymer having from about 20 wt % to about 50 wt % of an alkylene oxide. The polymer should have a molecular weight of from about 2,000 to about 20,000, or from about 3,000 to about 15,000, or from about 5,000 to about 13,000. The alkylene oxide (AO) component of the polymer is generally propylene oxide (PO) or ethylene oxide (EO) and generally comprises from about 20 wt % to about 50 wt %, or from about 30 wt % to about 45 wt %, or from about 30 wt % to about 40 wt % of the polymer. The alkoxylated side chains of the water soluble polymers may comprise from about 10 to about 55 AO units, or from about 20 to about 50 AO units, or from about 25 to 50 AO units. The polymers, preferably water soluble, may be configured as random, block, graft, or other known configurations. Methods for forming alkoxylated acrylic acid polymers are disclosed in U.S. Pat. No. 3,880,765.

Silicates

Preferred silicates are sodium silicates such as sodium disilicate, sodium metasilicate and crystalline phyllosilicates. Silicates if present are at a level of from about 1 to about 20%, preferably from about 5 to about 15% by weight of composition.

Bleach

Inorganic and organic bleaches are suitable cleaning actives for use herein. Bleach is present is at a level of from about 1 to about 20%, preferably from about 5 to about 15% by weight of composition. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated.

Alkali metal percarbonates, particularly sodium percarbonate are preferred perhydrates for use herein. The percarbonate is most preferably incorporated into the products in a coated form which provides in-product stability. A suitable coating material providing in product stability comprises mixed salt of a water-soluble alkali metal sulphate and carbonate. Such coatings together with coating processes have previously been described in GB-1,466,799. The weight ratio of the mixed salt coating material to percarbonate lies in the range from 1:200 to 1:4, more preferably from 1:99 to 1 9, and most preferably from 1:49 to 1:19. Preferably, the mixed salt is of sodium sulphate and sodium carbonate which has the general formula Na2SO4.n.Na2CO3 wherein n is from 0.1 to 3, preferably n is from 0.3 to 1.0 and most preferably n is from 0.2 to 0.5.

Another suitable coating material providing in product stability, comprises sodium silicate of SiO2:Na2O ratio from 1.8:1 to 3.0:1, preferably L8:1 to 2.4:1, and/or sodium metasilicate, preferably applied at a level of from 2% to 10%, (normally from 3% to 5%) Of SiO2 by weight of the inorganic perhydrate salt. Magnesium silicate can also be included in the coating. Coatings that contain silicate and borate salts or boric acids or other inorganics are also suitable.

Other coatings which contain waxes, oils, fatty soaps can also be used advantageously within the present invention.

Potassium peroxymonopersulfate is another inorganic perhydrate salt of utility herein.

Typical organic bleaches are organic peroxyacids including diacyl and tetraacylperoxides, especially diperoxydodecanedioc acid, diperoxytetradecanedioc acid, and diperoxyhexadecanedioc acid. Dibenzoyl peroxide is a preferred organic peroxyacid herein. Mono- and diperazelaic acid, mono- and diperbrassylic acid, and Nphthaloylaminoperoxicaproic acid are also suitable herein.

The diacyl peroxide, especially dibenzoyl peroxide, should preferably be present in the form of particles having a weight average diameter of from about 0.1 to about 100 microns, preferably from about 0.5 to about 30 microns, more preferably from about 1 to about 10 microns. Preferably, at least about 25%, more preferably at least about 50%, even more preferably at least about 75%, most preferably at least about 90%, of the particles are smaller than 10 microns, preferably smaller than 6 microns. Diacyl peroxides within the above particle size range have also been found to provide better stain removal especially from plastic dishware, while minimizing undesirable deposition and filming during use in automatic dishwashing machines, than larger diacyl peroxide particles. The preferred diacyl peroxide particle size thus allows the formulator to obtain good stain removal with a low level of diacyl peroxide, which reduces deposition and filming. Conversely, as diacyl peroxide particle size increases, more diacyl peroxide is needed for good stain removal, which increases deposition on surfaces encountered during the dishwashing process.

Further typical organic bleaches include the peroxy acids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ϵ-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi (6-aminopercaproic acid).

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 10 carbon atoms, in particular from 2 to 4 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). Bleach activators if included in the compositions of the invention are in a level of from about 0.1 to about 10%, preferably from about 0.5 to about 2% by weight of the total composition.

Bleach Catalyst

Bleach catalysts preferred for use herein include a manganese complex, e.g. Mn-Me TACN, as described in EP 458 397 A; Co, Cu, Mn and Fe bispyridylamine and related complexes (U.S. Pat. No. 5,114,611); and pentamine acetate cobalt(III) and related complexes (U.S. Pat. No. 4,810,410). A complete description of bleach catalysts suitable for use herein can be found in WO 99/06521, pages 34, line 26 to page 40, line 16. The preferred bleach catalyst for use herein is a manganese complex, e.g. Mn-Me TACN, as described in EP 458 397 A. This may be present in the form of an encapsulated separately from the bleach granule. Bleach catalyst if included in the compositions of the invention are in a level of from about 0.0001 to about 2%, preferably from about 0.001 to about 1% by weight of the total composition.

Enzyme

Enzyme Related Terminology

Nomenclature for Amino Acid Modifications

In describing enzyme variants herein, the following nomenclature is used for ease of reference: Original amino acid(s):position(s):substituted amino acid(s).

According to this nomenclature, for instance the substitution of glutamic acid for glycine in position 195 is shown as G195E. A deletion of glycine in the same position is shown as G195*, and insertion of an additional amino acid residue such as lysine is shown as G195GK. Where a specific enzyme contains a "deletion" in comparison with other enzyme and an insertion is made in such a position this is indicated as *36D for insertion of an aspartic acid in position 36. Multiple mutations are separated by pluses, i.e.: S99G+V102N, representing mutations in positions 99 and 102 substituting serine and valine for glycine and asparagine, respectively. Where the amino acid in a position (e.g. 102) may be substituted by another amino acid selected from a group of amino acids, e.g. the group consisting of N and I, this will be indicated by V102N/I.

In all cases, the accepted IUPAC single letter or triple letter amino acid abbreviation is employed.

Protease Amino Acid Numbering

The numbering used herein is numbering versus the so-called BPN' numbering scheme which is commonly used in the art and is illustrated for example in WO00/37627.

Amino Acid Identity

The relatedness between two amino acid sequences is described by the parameter "identity". For purposes of the present invention, the alignment of two amino acid sequences is determined by using the Needle program from the EMBOSS package (http://emboss.org) version 2.8.0. The Needle program implements the global alignment algorithm described in Needleman, S. B. and Wunsch, C. D. (1970) J. Mol. Biol. 48, 443-453. The substitution matrix used is BLOSUM62, gap opening penalty is 10, and gap extension penalty is 0.5.

The degree of identity between an amino acid sequence of and enzyme used herein ("invention sequence") and a different amino acid sequence ("foreign sequence") is calculated as the number of exact matches in an alignment of the two sequences, divided by the length of the "invention sequence" or the length of the "foreign sequence", whichever is the shortest. The result is expressed in percent identity. An exact match occurs when the "invention sequence" and the "foreign sequence" have identical amino acid residues in the same positions of the overlap. The length of a sequence is the number of amino acid residues in the sequence.

Preferred enzyme for use herein includes a protease. Suitable proteases include metalloproteases and serine proteases, including neutral or alkaline microbial serine proteases, such as subtilisins (EC 3.4.21.62). Suitable proteases include those of animal, vegetable or microbial origin. In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease. Examples of suitable neutral or alkaline proteases include:

(a) subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii* described in U.S. Pat. No. 6,312,936 B1, U.S. Pat. No. 5,679,630, U.S. Pat. No. 4,760,025, U.S. Pat. No. 7,262,042 and WO09/021,867.

(b) trypsin-type or chymotrypsin-type proteases, such as trypsin (e.g., of porcine or bovine origin), including the *Fusarium* protease described in WO 89/06270 and the chymotrypsin proteases derived from Cellumonas described in WO 05/052161 and WO 05/052146.

(c) metalloproteases, including those derived from *Bacillus amyloliquefaciens* described in WO 07/044,993A2.

Preferred proteases include those derived from *Bacillus gibsonii* or *Bacillus Lentus.*

Especially preferred proteases for the detergent of the invention are polypeptides demonstrating at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627, which is incorporated herein by reference:

68, 87, 99, 101, 103, 104, 118, 128, 129, 130, 167, 170, 194, 205 & 222 and optionally one or more insertions in the region comprising amino acids 95-103.

Preferably, the mutations are selected from one or more, preferably two or more and more preferably three or more of the following: V68A, N87S, S99D, S99SD, S99A, S101G, S103A, V104N/I, Y167A, R170S, A194P, V205I and/or M222S.

Most preferably the protease is selected from the group comprising the below mutations (BPN' numbering system) versus either the PB92 wild-type (SEQ ID NO:2 in WO 08/010,925) or the subtilisin 309 wild-type (sequence as per PB92 backbone, except comprising a natural variation of N87S).

(i) G118V+S128L+P129Q+S130A
(ii) G118V+S128N+P129S+S130A+S166D
(iii) G118V+S128L+P129Q+S130A+S166D
(iv) G118V+S128V+P129E+S130K
(v) G118V+S128V+P129M+S166D
(vi) G118V+S128F+P129L+S130T
(vii) G118V+S128L+P129N+S130V
(viii) G118V+S128F+P129Q
(ix) G118V+S128V+P129E+S130K+S166D
(x) G118V+S128R+P129S+S130P
(xi) S128R+P129Q+S130D
(xii) S128C+P129R+S130D
(xiii) S128C+P129R+S130G
(xiv) S101G+V104N
(xv) N76D+N87S+S103A+V104I
(xvi) V68A+N87S+S101G+V104N
(xvii) S99SD+S99A
(xviii) N87S+S99SD+S99A Suitable commercially available protease enzymes include those sold under the trade names Alcalase®, Savinase®, Primase®, Durazym®, Polarzyme®, Kannase®, Liquanase®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, those sold under the tradename Opticlean® and Optimase® by Solvay Enzymes, those available from Henkel/Kemira, namely BLAP (sequence shown in FIG. 29 of U.S. Pat. No. 5,352,604 with the following mutations S99D+S101R+S103A+V104I+G159S, hereinafter referred to as BLAP), BLAP R (BLAP with S3T+V4I+V199M+V205I+L217D), BLAP X (BLAP with S3T+V4I+V205I) and BLAP F49 (BLAP with S3T+V4I+A194P+V199M+V205I+L217D)—all from Henkel/Kemira; and KAP (*Bacillus alkalophilus* subtilisin with mutations A230V+S256G+S259N) from Kao.

Preferred levels of protease in the compositions of the invention include from about 0.1 to about 10, more preferably from about 0.5 to about 5 and especially from about 1 to about 4 mg of active protease per grams of composition.

Preferred enzyme for use herein includes alpha-amylases, including those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334).

Preferred amylases include:

(a) the variants described in WO 94/02597, WO 94/18314, WO96/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444.

(b) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:

26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, preferably that also contain the deletions of D183* and G184*.

(c) variants exhibiting at least 90% identity with SEQ ID No. 4 in WO06/002643, the wild-type enzyme from *Bacillus* SP722, especially variants with deletions in the 183 and 184 positions and variants described in WO 00/60060, which is incorporated herein by reference.

(d) variants exhibiting at least 95% identity with the wild-type enzyme from *Bacillus* sp. 707 (SEQ ID NO:7 in U.S. Pat. No. 6,093,562), especially those comprising one or more of the following mutations M202, M208, S255, R172, and/or M261. Preferably said amylase comprises one or more of M202L, M202V, M202S, M202T, M202I, M202Q, M202W, S255N and/or R172Q. Particularly preferred are those comprising the M202L or M202T mutations.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, POWERASE®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). In one aspect, suitable amylases include NATALASE®, STAINZYME® and STAINZYME PLUS®, POWERASE® and mixtures thereof.

Preferably, the composition of the invention comprises at least 0.01 mg of active alpha-amylases per gram of composition, preferably from about 0.05 to about 10, more preferably from about 0.1 to about 6, especially from about 0.2 to about 4 mg of alpha-amylases per gram of composition.

Metal Care Agents

Metal care agents may prevent or reduce the tarnishing, corrosion or oxidation of metals, including aluminium, stainless steel and non-ferrous metals, such as silver and copper. Suitable examples include one or more of the following:

(a) benzatriazoles, including benzotriazole or bis-benzotriazole and substituted derivatives thereof. Benzotriazole derivatives are those compounds in which the available substitution sites on the aromatic ring are partially or completely substituted. Suitable substituents include linear or branch-chain C1-C20-alkyl groups and hydroxyl, thio, phenyl or halogen such as fluorine, chlorine, bromine and iodine.

(b) metal salts and complexes chosen from the group consisting of zinc, manganese, titanium, zirconium, hafnium, vanadium, cobalt, gallium and cerium salts and/or complexes, the metals being in one of the oxidation states II, III, IV, V or VI. In one aspect, suitable metal salts and/or metal complexes may be chosen from the group consisting of Mn(II) sulphate, Mn(II) citrate, Mn(II) stearate, Mn(II) acetylacetonate, K2TiF6, K2ZrF6, CoSO4, Co(NO3)2 and Ce(NO3)3, zinc salts, for example zinc sulphate, hydrozincite or zinc acetate;

(c) silicates, including sodium or potassium silicate, sodium disilicate, sodium metasilicate, crystalline phyllosilicate and mixtures thereof.

Further suitable organic and inorganic redox-active substances that act as silver/copper corrosion inhibitors are disclosed in WO 94/26860 and WO 94/26859.

Preferably the composition of the invention comprises from 0.1 to 5%, more preferably from 0.2 to 4% and specially from 0.3 to 3% by weight of the total composition of a metal care agent, preferably the metal care agent is a zinc salt.

Unit Dose Form

Preferably the product of the invention is a unit-dose product. Products in unit dose form include tablets, capsules, sachets, pouches, etc. Preferred for use herein are tablets and unit dose form wrapped with a water-soluble film (including wrapped tablets, capsules, sachets, pouches) and injection moulded containers. The unit dose form of the invention is preferably a water-soluble multi-compartment pack.

A multi-compartments pack is formed by a plurality of water-soluble enveloping materials which form a plurality of compartments, one of the compartments would contain the composition of the invention, another compartment can contain a liquid composition, the liquid composition can be aqueous (i.e. comprises more than 10% of water by weight of the liquid composition) and the compartment can be made of warm water soluble material. In some embodiments the compartment comprising the composition of the invention is made of cold water soluble material. It allows for the separation and controlled release of different ingredients. In other embodiments all the compartments are made of warm water soluble material.

Preferred packs comprise at least two side-by-side compartments superposed (i.e., placed above) onto another compartment, especially preferred are pouches. This disposition contributes to the compactness, robustness and strength of the pack, additionally, it minimise the amount of water-soluble material required. It only requires three pieces of material to form three compartments. The robustness of the pack allows also for the use of very thin films without compromising the physical integrity of the pack. The pack is also very easy to use because the compartments do not need to be folded to be used in machine dispensers of fix geometry. At least two of the compartments of the pack contain two different compositions. By "different compositions" herein is meant compositions that differ in at least one ingredient.

Preferably, at least one of the compartments contains a solid composition and another compartment an aqueous liquid composition, the compositions are preferably in a solid to liquid weight ratio of from about 20:1 to about 1:20, more preferably from about 18:1 to about 2:1 and even more preferably from about 15:1 to about 5:1. This kind of pack is very versatile because it can accommodate compositions having a broad spectrum of values of solid:liquid ratio. Particularly preferred have been found to be pouches having a high solid: liquid ratio because many of the detergent ingredients are most suitable for use in solid form, preferably in powder form. The ratio solid:liquid defined herein refers to the relationship between the weight of all the solid compositions and the weight of all the liquid compositions in the pack.

Preferably solid:liquid weight ratio is from about 2:1 to about 18:1, more preferably from about 5:1 to about 15:1. These weight ratios are suitable in cases in which most of the ingredients of the detergent are in liquid form.

Preferably the two side-by-side compartments contain liquid compositions, which can be the same but preferably are different and another compartment contains a solid composition, preferably in powder form, more preferably a densified powder. The solid composition contributes to the strength and robustness of the pack.

For dispenser fit reasons, especially in an automatic dishwasher, the unit dose form products herein have a square or rectangular base and a height of from about 1 to about 5 cm, more preferably from about 1 to about 4 cm. Preferably the weight of the solid composition is from about 5 to about 20 grams, more preferably from about 10 to about 15 grams and the weight of the liquid compositions is from about 0.5 to about 4 grams, more preferably from about 0.8 to about 3 grams.

In preferred embodiments, at least two of the films which form different compartments have different solubility, under the same conditions, releasing the content of the compositions which they partially or totally envelope at different times.

Controlled release of the ingredients of a multi-compartment pouch can be achieved by modifying the thickness of the film and/or the solubility of the film material. The solubility of the film material can be delayed by for example cross-linking the film as described in WO 02/102,955 at pages 17 and 18. Other water-soluble films designed for rinse release are described in U.S. Pat. No. 4,765,916 and U.S. Pat. No. 4,972,017. Waxy coating (see WO 95/29982) of films can help with rinse release. pH controlled release means are described in WO 04/111178, in particular amino-acetylated polysaccharide having selective degree of acetylation.

Other means of obtaining delayed release by multi-compartment pouches with different compartments, where the compartments are made of films having different solubility are taught in WO 02/08380.

All the percentages here in are by weight of the composition, unless stated otherwise.

Example

An automatic detergent powder having the formula tabulated below was prepared.

| Ingredient | Grams |
|---|---|
| STPP | 9.5 |
| Carbonate | 3 |
| Silicate | 0.2 |
| Zinc carbonate | 0.001 |
| Percarbonate | 2 |
| TAED | 0.5 |
| Bleach catalyst | 0.00019 |

The exemplified composition in addition to 1.9 g of surfactant and 0.8 g of sulfonated polymer (as specified in the table below) was used to wash a plastic load in an automatic dishwasher Bosch Exxcel, the program used was Eco 50. Hard water was used. The load was washed in the presence of 50 g of a soil as specified below. The items were grading 30 minutes after the end of the drying cycle. Grading scale: 10: perfectly dry and 1: completely wet. As it can be seen from the table below, the best drying results by far correspond to case C, wherein a detergent composition according to the invention was used. The items also present good filming and spotting.

| | Average | | |
|---|---|---|---|
| | A (SLF18 + 588) 7.5 | B (LF224 + 588) 6.5 | C (LF731 + 588) 9.5 |
| ASDA PP Jug | 7 | 5 | 8.5 |
| LDPE Clear lid 1 | 7 | 5 | 10 |
| LDPE Clear lid 2 | 6 | 4 | 10 |
| PP Box Tesco | 6.5 | 4.5 | 10 |
| PP Box Whitefurze | 8 | 7 | 10 |
| Melamine Blue bowl | 10 | 10 | 10 |
| Melamine Blue tumbler | 10 | 10 | 10 |

SLF 18: Non-ionic surfactant available from BASF
LF224: Low foaming non-ionic surfactant available from BASF
LF731: esterified alkyl alkoxylated surfactant according to the invention. Available from BASF.
588: Acusol 588G sulfonated polymer supplied by Rohm & Haas Soil Composition and Preparation

| Ingredients | |
|---|---|
| Crisp and Dry solid oil | 300 g +/− 1 g |
| Scott's Oatmeal | 100 g +/− 1 g |
| Stork Margarine | 150 g +/− 1 g |
| Caged Medium Egg Yolk (Separate the yolks and wash in cold City [medium hard] water before use). | 300 g +/− 1 g |
| Defrosted Asda Frozen Spinach (Sieve before use to remove excess water). | 100 g +/− 1 g |
| Asda UHT full fat milk | 50 g +/− 1 g |

The above ingredients are weighed into a food processor and then the ingredients are blended together for 10 mins.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention

What is claimed is:

1. An automatic dishwashing detergent composition for use in the main wash of a dishwasher to provide drying wherein the detergent consists of:

a.) an esterified alkyl alkoxylated surfactant of general formula (I)

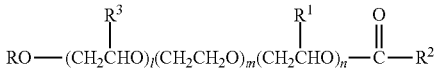

where

R is a branched or unbranched alkyl radical having 8 to 16 carbon atoms;

$R^3$, $R^1$ independently of one another, are hydrogen or a branched or unbranched alkyl radical having 1 to 5 carbon atoms;

$R^2$ is an unbranched alkyl radical having 5 to 17 carbon atoms;

l, n independently of one another, are a number from 1 to 5 and m is a number from 13 to 35;

b.) a dispersant selected from the group of organic polymers, organic builders and mixtures thereof; and c.) an alcohol ethoxylated surfactant, and d.) optionally: inorganic builders, enzymes, bleach, bleach activator, bleach catalyst, and metal care agents.

2. A detergent composition according to claim 1 wherein the organic polymer is a carboxylated polymer.

3. A detergent composition according to claim 1 wherein the organic builder is selected from methyglycinediacetic acid, glutamic acid, carboxymethyl inulin and mixtures thereof.

4. A detergent composition according to claim 1 wherein the esterified alkyl alkoxylated surfactant and the alcohol ethoxylated surfactant are present in a weight ratio of from about 1:1 to about 10:1.

5. A detergent composition according to claim 1 wherein the alcohol ethoxylated surfactant has an aliphatic alcohol chain containing from about 10 to 14 carbon atoms and from 5 to 8 molecules of ethylene oxide.

6. A detergent composition according to claim 1 wherein the enzyme is selected from:

a) a protease demonstrating at least 90% identity with the wild-type enzyme from *Bacillus lentus*, comprising mutations in one or more of the following positions, using the BPN' numbering system and amino acid abbreviations:

68, 87, 99, 101, 103, 104, 118, 128, 129, 130, 167, 170, 194, 205 & 222 and optionally one or more insertions in the region comprising amino acids 95-103;

b) an amylase exhibiting at least 95% identity with the wild-type enzyme from *Bacillus* sp. 707 comprising SEQ ID NO: 7 comprising one or more of the following mutations M202, M208, S255, R172, and/or M261; and c) a mixture thereof.

7. A detergent composition according to claim 1 in the form of a unit dose.

8. A method of dishwashing in a dishwasher comprising the step of delivering a detergent according to claim 1 into the main wash of the dishwasher.

9. A method of achieving drying through the wash in a dishwasher according to claim 1 into the main wash of the dishwasher.

* * * * *